US005092137A

United States Patent [19]

Elsom

[11] Patent Number: 5,092,137

[45] Date of Patent: Mar. 3, 1992

[54] REFRIGERATOR COLD AIR DUCT APPARATUS

[75] Inventor: Kyle B. Elsom, Cedar Rapids, Iowa

[73] Assignee: Amana Refrigeration, Inc., Amana, Iowa

[21] Appl. No.: 701,276

[22] Filed: May 16, 1991

[51] Int. Cl.[5] ..... F25D 23/02

[52] U.S. Cl. ..... 62/408; 62/447

[58] Field of Search ..... 62/440, 441, 443, 447, 62/265, 407, 408, 187; 98/413

[56] References Cited

U.S. PATENT DOCUMENTS

| | | | |
|---|---|---|---|
| 3,126,717 | 3/1964 | Schumacher | 62/187 |
| 3,359,751 | 12/1967 | Stevens | 62/441 |
| 4,488,412 | 12/1984 | Weaver et al. | 62/382 |
| 4,539,819 | 9/1985 | Alba et al. | 62/78 |
| 4,586,347 | 5/1986 | McCarty | 62/265 |

*Primary Examiner*—Albert J. Makay
*Assistant Examiner*—William C. Doerrler
*Attorney, Agent, or Firm*—William R. Clark; Richard M. Sharkansky

[57] ABSTRACT

Refrigerator duct apparatus adapted for conveying cold air from the evaporator chamber within the freezer liner to a intermediate temperature storage chamber within the fresh food liner. The duct is coupled to an outlet aperture in the freezer liner using and adjustable joint that permits motion of the duct for alignment of the outlet port of the duct to an inlet aperture in the fresh food liner. Specifically, the inlet port of the duct has a mating flange with ears that are insertable through the outlet aperture in the fresh food liner in a predetermined rotational orientation. After insertion, the duct is rotated so that the ears engage peripheral portions of the outlet aperture. A dimension of the outlet aperture is larger than a corresponding dimension of the mating flange to permit the duct to be moved back and forth while the ears remain in sliding engagement on the peripheral portions to align the duct outlet port to the inlet aperture of the fresh food liner.

19 Claims, 5 Drawing Sheets

REFRIGERATOR COLD AIR DUCT APPARATUS

BACKGROUND OF THE INVENTION

The field of the invention generally relates to refrigerators, and more particularly relates to duct apparatus that conveys cold air from the freezer compartment through foamed-in-place insulation to a storage chamber within the fresh food compartment.

As is well known, most domestic refrigerators are insulated using a so-called foam-in-place process. In such process, a plastic liner is positioned in spaced relationship within an outer metal shell. Then, foam insulation is injected under pressure into the space between the liner and the shell, and the foam flows along the bottom, sides, and top of the liner filling all voids in the space. Subsequently, the foam solidifies and becomes a layer of rigid insulation surrounding the liner.

In the case of a side-by-side refrigerator, a freezer liner is generally positioned on one side and a fresh food liner is positioned on the other side. The two liners are spaced from each other so that the foam flows into the region therebetween forming a vertical partition. Typically, an evaporator chamber is formed within the freezer liner and a single fan is used to circulate air from the freezer and fresh food compartments over the evaporator and back to the respective compartments. The evaporator is activated and the air is proportioned so that the freezer compartment is generally maintained at approximately 0° F. while the fresh food compartment is approximately 40° F.

It is also well known that it is desirable to maintain certain foods at a temperature that is lower than the fresh food compartment. For example, it may be desirable to store meat or beverages at a temperature in the range of 32° F.–35° F. which is intermediate to the temperatures of the freezer and the fresh food compartments. For this purpose, many refrigerators have a meat keeper storage drawer, and some also have a beverage or quick chill storage chamber which typically is located within the door of the fresh food compartment.

U S. Pat. No. 4,586,347 discloses a side-by-side refrigerator having an intermediate temperature (e.g. 28°–32° F.) chamber within the fresh food compartment door. A port or passage is provided directly through the vertical partition between freezer and fresh food compartments, and the respective pressures are maintained so that cold air flows from the freezer compartment laterally through the passage in the partition to the storage chamber in the fresh food compartment door. However, with a wide range of freezer and fresh food compartment operating conditions such as the size and quantity of stored food, the pressures in the respective compartments may tend to be variable. Therefore, with such arrangement, it may be difficult to regulate the temperature within the storage chamber.

It would be desirable to provide a generally front-to-back duct to convey cold air directly from the evaporator chamber in the rear of the freezer liner to an intermediate temperature storage chamber within the fresh food compartment. With such arrangement, the pressure differential between the cold air source and the storage chamber would be relatively constant when the fan is operating, so the air flow rate could be accurately controlled. However, freezer and fresh food liners may not be precisely positioned within the shell so there may be a dimensional tolerance between the respective liner apertures through which the cold air is conveyed. Thus, it may be difficult to align the inlet and outlet ports of a duct to the respective liner cold air conveying apertures. The task is further complicated because the connections or joints of the duct to the respective liner apertures must be suitably sealed so that foam under pressure does not leak through the joints during the foam-in-place process.

SUMMARY OF THE INVENTION

It is an object of the invention to provide improved apparatus for conveying cold air to a storage chamber within the fresh food compartment.

It is also an object to provide a duct that conveys the cold air from the evaporator chamber to the storage chamber so that the pressure differential and thus the air flow rate is relatively constant when the fan is operating.

It is a further object to provide a duct that couples from an air outlet aperture in the freezer line to an air inlet aperture in the fresh food liner, such duct being relatively easy to align during fabrication even though there may be a tolerance in the alignment of the fresh food liner with respect to the freezer liner.

It is a further object to provide a coupling or joint between the duct and the freezer liner that is suitably sealed for a subsequent foam-in-place process.

In accordance with the invention, a refrigerator comprises a cabinet, a freezer liner, and a fresh food liner adjacently spaced within the cabinet wherein the freezer liner has an air outlet aperture and the fresh food liner has an air inlet aperture. A duct extends between the air outlet aperture of the freezer liner and the air inlet aperture of the fresh food liner for conveying cold air. The duct comprises means for coupling the duct to the outlet aperture and for adjusting the position of the duct with respect to the outlet aperture during fabrication to align the duct to the inlet aperture of the fresh food liner while maintaining the coupling to the outlet aperture. It is preferable that the refrigerator further comprises a storage chamber disposed to receive the cold air from the duct through the inlet aperture of the fresh food liner. It is also preferable that the duct comprises a port for receiving the cold air from the air outlet aperture and the coupling and adjusting means comprises a flange surrounding the port and extending through the air outlet aperture wherein the flange has a plurality of lugs engaging peripheral portions of the outlet aperture, such lugs being insertable during fabrication through the air outlet aperture in a first predetermined orientation of the flange with respect to the air outlet aperture. It is also preferable that the peripheral portions of the air outlet aperture comprise a pair of parallel edges each having a length longer than a corresponding dimension of the flange so that the flange can be adjusted in position along the parallel edges during fabrication while the lugs move in sliding engagement along the parallel edges. The refrigerator may also comprise foamed-in-place insulation between the freezer and fresh food liners surrounding the duct. Also, a gasket may surround the flange and be disposed between the duct and the freezer liner.

The invention can also be practiced by a refrigerator comprising an outer cabinet surrounding a freezer compartment comprising a freezer liner and a fresh food compartment comprising a fresh food liner wherein the freezer liner and the fresh food liner are laterally spaced in the cabinet forming a vertical partition region therebetween. An evaporator is disposed in an evaporator chamber within the freezer liner and means comprising a fan circulates air from the freezer and fresh food compartments through the evaporator chamber across the evaporator and back to the freezer and fresh food compartments. A storage chamber is disposed in the fresh food compartment and the freezer liner has an outlet aperture communicating from the evaporator chamber to the vertical partition region while the fresh food liner has an inlet aperture communicating from the vertical partition region to the storage chamber. A duct means is disposed in the vertical partition region for conveying evaporator chamber air from the outlet aperture through the vertical partition region to the inlet aperture for discharge into the storage chamber. The duct means comprises a first port for receiving the air from the outlet aperture and a second port for discharging the air through the inlet aperture. In accordance with the invention, the duct means comprises a collar surrounding the first port and extending through the outlet aperture wherein the collar has a plurality of ears insertable through the outlet aperture in a first rotational orientation of the collar to the outlet aperture and engageable to peripheral portions of the outlet aperture in a second rotational orientation of the collar to the outlet aperture to interlock the duct means to the freezer liner in the second rotational orientation. The outlet aperture have at least one dimension larger than a corresponding dimension of the collar in the second rotational orientation so that the collar can be moved within the outlet aperture during fabrication to align the second port with the inlet aperture of the fresh food liner while maintaining sliding engagement of the ears on the peripheral portions to maintain the interlock between the duct means and the freezer liner in the second rotational orientation. It is preferable that the freezer liner outlet aperture have two substantially parallel edges approximately orthogonal to the ears in the second rotational orientation. Also, it is preferable that the collar have an elongated cross-section with rounded ends and that the ears project from the rounded ends. Also, the collar may have a distal portion of reduced cross-section thereby defining a shoulder on the collar. A gasket is preferably sandwiched on the shoulder between the freezer liner around the air outlet aperture.

With such arrangement, the duct can initially be mounted to the freezer liner at the outlet aperture so that it communicates with the evaporator chamber. Then, after the fresh food liner is positioned within the cabinet, the duct may be adjusted so that its outlet port aligns with the inlet aperture of the fresh food liner. During such alignment, the joint or coupling between the duct and the freezer liner remains sealed so that a subsequent foaming-in-process can be accomplished.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENTS

Figure 1:
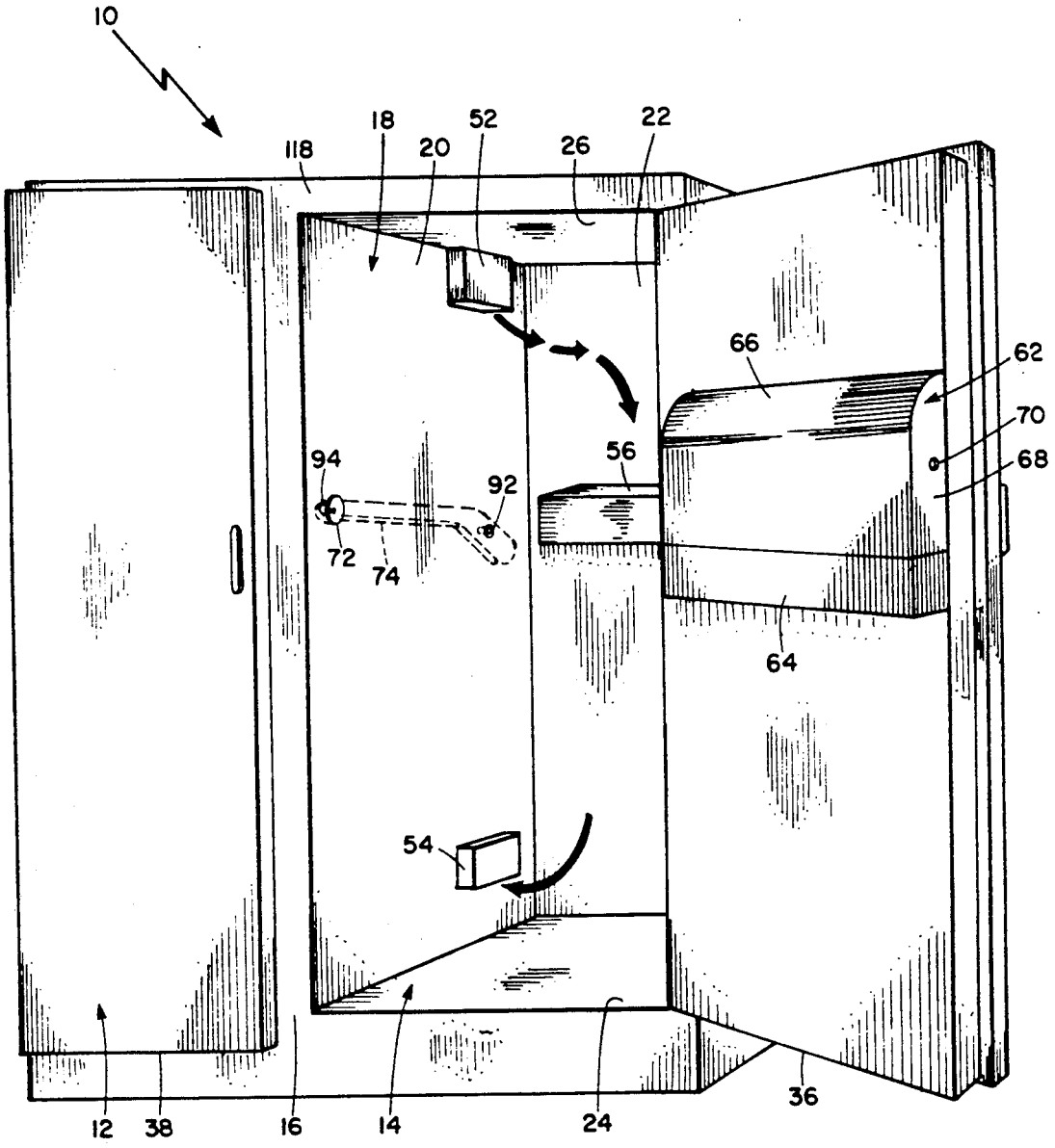
FIG. 1 is a front perspective view of a side-by-side refrigerator.
Figure 2:
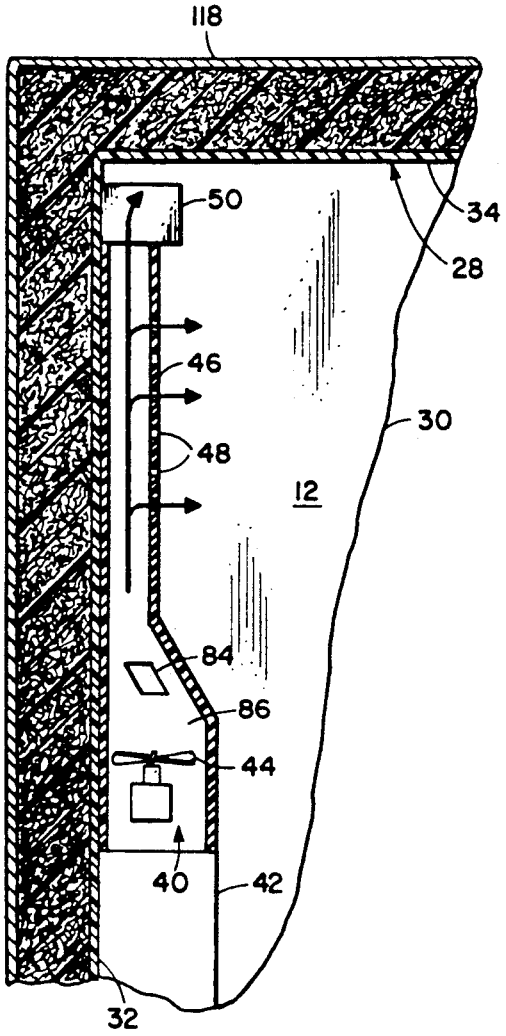
FIG. 2 is a side sectioned view of the evaporator chamber within the freezer liner.

Referring to the drawings wherein like numerals refer to like parts throughout the several views, FIG. 1 shows a pictorial view of refrigerator 10. Here, refrigerator 10 is a so-called side-by-side refrigerator having a freezer compartment 12 on the left and a fresh food compartment 14 on the right with a vertical partition 16 therebetween. The fresh food compartment 14 is formed or bounded to a fresh food liner 18 having side walls 20, a back wall 22, a floor 24, and a ceiling 26. With reference to FIG. 2, freezer compartment 12 is formed or bounded by freezer liner 28 having side walls 30, back wall 32, floor (not shown), and ceiling 34. Door 36 seals the fresh food compartment 14, and door 38 seals freezer compartment 12.

Still referring to FIG. 2, evaporator chamber 40 is disposed in the rear of freezer liner 28 and houses evaporator 42 and fan 44. In conventional manner, evaporator 42 is cooled by a refrigerant loop (not shown) and fan 44 draws sub-freezing air up from evaporator 42 and directs the cold air upwardly into air baffle 46 which extends substantially the full width of freezer compartment 12. A portion of the cold air is directed forwardly into the freezer compartment 12 through discharge vents 48 in air baffle 46, and another portion is directed into the fresh food air supply passage 50 to the control damper 52 in the fresh food compartment 14 as shown in FIG. 1. Control damper 52 has a conventional operator controlled thermostat that regulates the amount of cold air flowing into fresh food compartment 14. Air from fresh food compartment 14 is recirculated back to the underside of evaporator 42 via fresh food compartment air return passage 54. Similarly, air from freezer compartment 12 is recirculated to the underside of evaporator 42. In such manner, a single fan 44 is used to recirculate sub-freezing or cold air from evaporator chamber 40 through both the freezer compartment 12 and fresh food compartment 14. The relative temperatures of the freezer compartment 12 and fresh food compartment 14 are regulated by a freezer compartment thermostat control (not shown) and control damper 52. Typically, the user will set the controls so that freezer compartment 12 is maintained at approximately 0° F. while fresh food compartment 14 is maintained at approximately 40° F.

Still referring to FIG. 1, conventional meat keeper 56 is suitably mounted in fresh food compartment 14 and, as will be described subsequently, a stream of cold air is directed to meat keeper 56 in order to maintain the interior of meat keeper 56 at a temperature below the rest of the fresh food compartment 14. More specifically, meat keeper 56 may include a segregated food storage chamber or drawer 58 (FIG. 3) surrounded by a sleeve 60, and the cold air is directed within the sleeve 60 in conventional manner so as to maintain meat within drawer 58 at a temperature in the range from 32°-35° F.

Another segregated storage chamber 62 is disposed within door 36. As described in detail in U.S. Pat. application Ser. No. 534,224, filed June 7, 1990, which is hereby incorporated by reference, storage chamber 62 may typically comprise a lower shelf 64 supporting a vertically slidable inner door 66. Inner door 66 has a side panel 68 with an opening 70 that aligns with air flow control 72 that mounts on wall 20 and regulates the temperature of storage chamber 62. As will be described subsequently, a stream of air is directed from air flow control 72 into storage chamber 62 through opening 70. The cold air maintains storage chamber 62 at a temperature lower than the rest of the fresh food compartment 14. For example, storage chamber 62 may typically be maintained at approximately 32° F. so as to quickly chill certain foods or maintain beverages at a colder temperature than the rest of the fresh food compartment 14.

Figure 3:
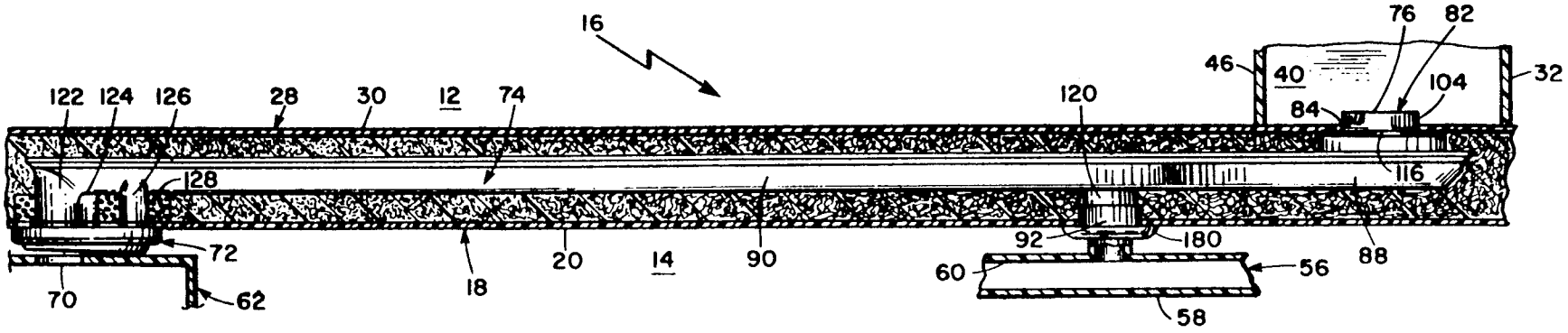
FIG. 3 is a top view of a duct in the vertical partition coupled between the freezer liner and the fresh food liner.
Figure 4:
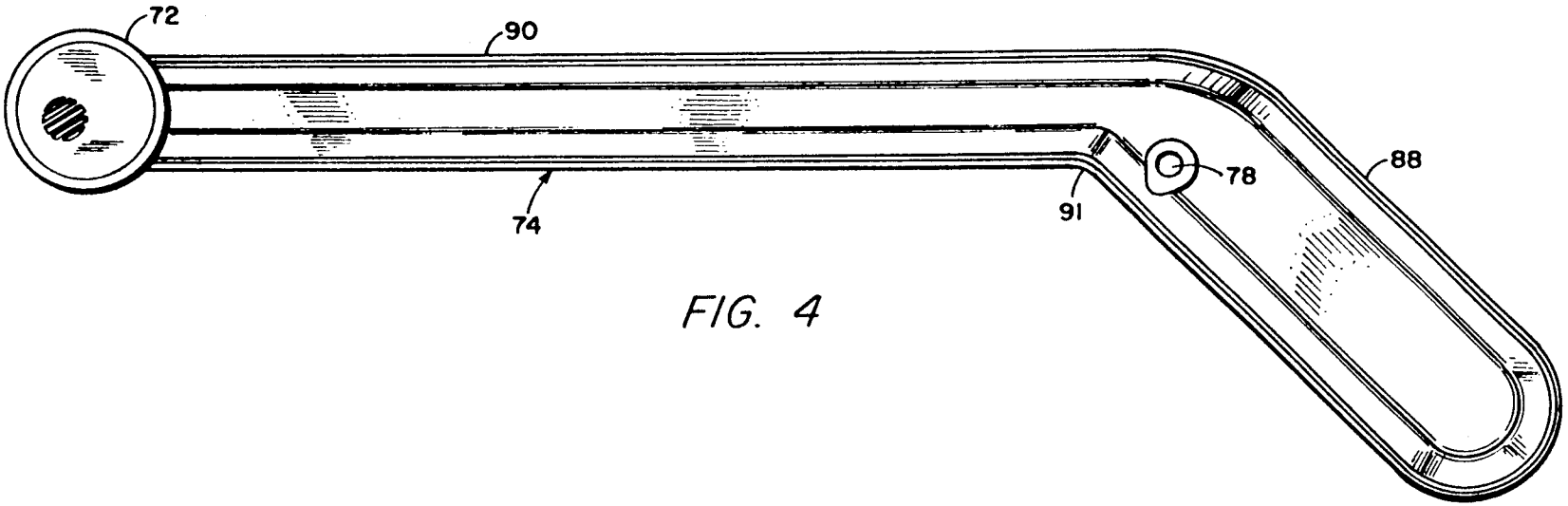
FIG. 4 is a side view of the duct and air flow control from the fresh food compartment side.

Referring to FIG. 3, duct 74 conveys sub-freezing or cold air from evaporator chamber 40 to both the meat keeper 56 and storage chamber 62. More specifically, with reference also to FIGS. 4-8, duct 74 has an inlet port 76 positioned adjacent to a rear end thereof, and outlet ports 78 and 80 for discharging sub-freezing air respectively into meat keeper 56 and storage chamber 62. Inlet port 76 is surrounded by a collar 82 or mating flange that projects laterally and extends through an outlet aperture 84 in the right freezer liner wall 30 to communicate with a plenum region 86 of evaporator chamber 40 above fan 44. With such arrangement, plenum region 86 has slightly positive pressure and therefore cold air from evaporator 42 is forced laterally into duct 74 through inlet port 76. Duct 74 is an assembly of plastic molded parts, and defines a generally elongated conduit that is preferably trapezoid shaped to enable the easy flow of foam around duct 74 during fabrication. Duct 74 has first and second legs 88 and 90 with an bend 91 therebetween generally arranged so that duct 74 covers or is aligned with fresh food liner inlet apertures 92 and 94 which communicate with meat keeper 56 and storage chamber 62, respectively.

Figure 6:
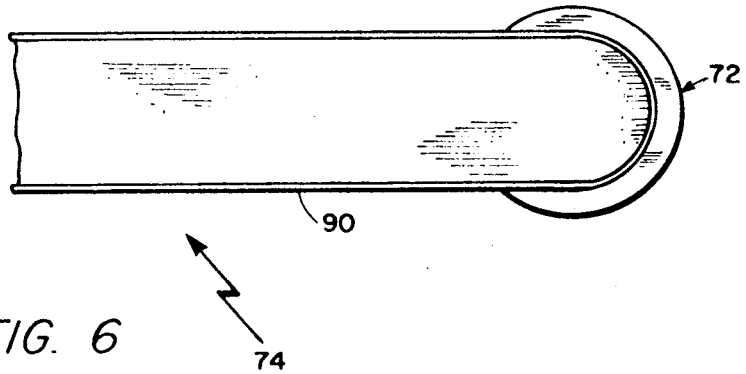
FIG. 6 is a partially broken away side view; of the duct from the freezer compartment side.

Referring to FIG. 6, leg 88 has a longitudinal baffle 96 or partition that separates leg 88 into two parallel branches 98*a* and 98*b*. Branch 98*b* includes outlet port 78 and terminates with end wall 100 whereas branch 98*a* continues around bend 91 and down leg 90 to outlet port 80. With such arrangement, the flow of cold air from inlet port 76 to outlet port 78 and outlet port 80 is substantially isolated such that flow to one does not substantially affect flow to the other. Therefore, in a manner to be described subsequently, the temperature of meat keeper 56 and storage chamber 62 can be independently controlled. As shown, the cross section of leg 88 is larger than leg 90. For example, the cross-sectional area of branch 98*a* and 98*b* and leg 90 may be approximately equal so that a sufficient stream of cold air can be provided to both meat keeper 56 and storage chamber 62.

Figure 7:
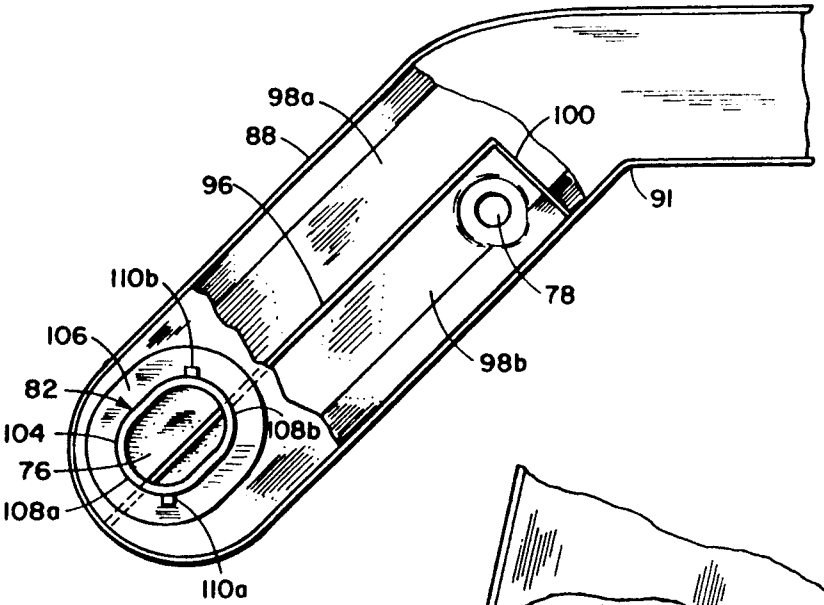
FIG. 7 is a view of the collar or attaching flange in position for insertion through the outlet aperture in the wall of the freezer liner.
Figure 7:
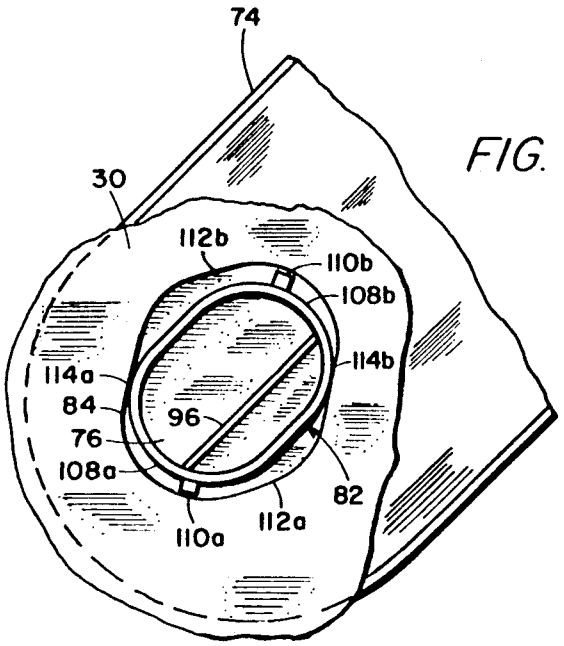
Figure 8:
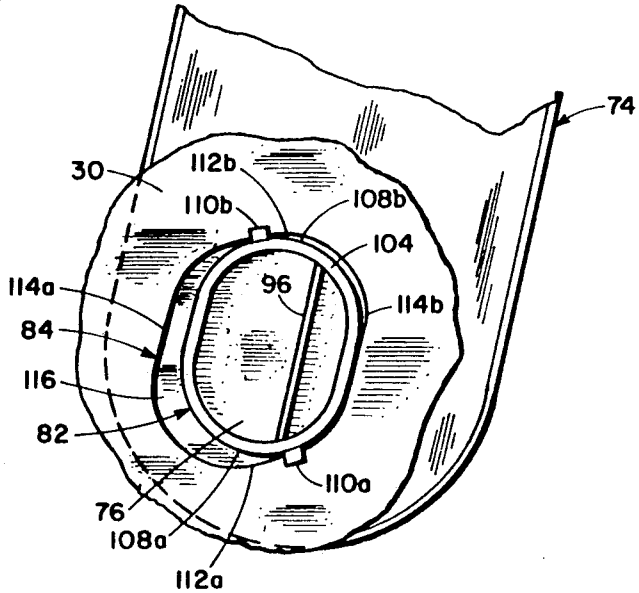
FIG. 8 is a view of the collar and duct rotated to a second rotational orientation wherein the ears interlock with peripheral portions of the outlet aperture.

During fabrication, duct 74 is initially attached to freezer liner 28. More specifically, with reference to FIGS. 2 and 6-8, collar 82 or mating flange has a distal portion 104 of reduced cross section thereby defining a shoulder 106. Distal portion 104 has an oval shape or an elongated form having rounded ends 108*a* and *b* from which project ears 110*a* and *b* or lugs at an angle from the longitudinal direction. Outlet aperture 84 in wall 30 of freezer liner 28 has a shape generally conforming to the shape of distal portion 104, but is also elongated in a generally transverse or orthogonal direction. Thus, outlet aperture 84 generally has a parallelogram shape with respective parallel edges 112*a* and *b* and 114*a* and *b* with rounded corners conforming to distal portion 104 therebetween. The dimensions are such that ears 110*a* and *b* are only insertable through outlet aperture 84 in a predetermined rotation orientation of duct 74 to side wall 30 of liner 28 as shown in FIG. 7. Therefore, in this predetermined orientation, distal portion 104 of latching collar 82 is inserted through outlet aperture 84 until gasket 116 contacts the outer surface of side wall 30 and is sandwiched between side wall 30 and shoulder 106. Then, as shown in FIG. 8, duct 74 and collar 82 are rotated to a second predetermined orientation wherein ear 110*a* and *b* rotate and engage peripheral portions along edges 112*a* and *b* thereby latching collar 82 and duct 74 to side wall 30 of freezer liner 28. In other words, duct 74 is interlocked to freezer liner 30 and a sealed coupling or joint is formed. In order to temporarily hold duct 74 in the latched or mated orientation shown in FIG. 8, the front end of leg 90 is temporarily taped to side wall 30 of freezer liner 28. Next, the freezer liner 28 is lowered in to the left side of the refrigerator cabinet 118 which is an outer metal shell or casing.

Figure 5:
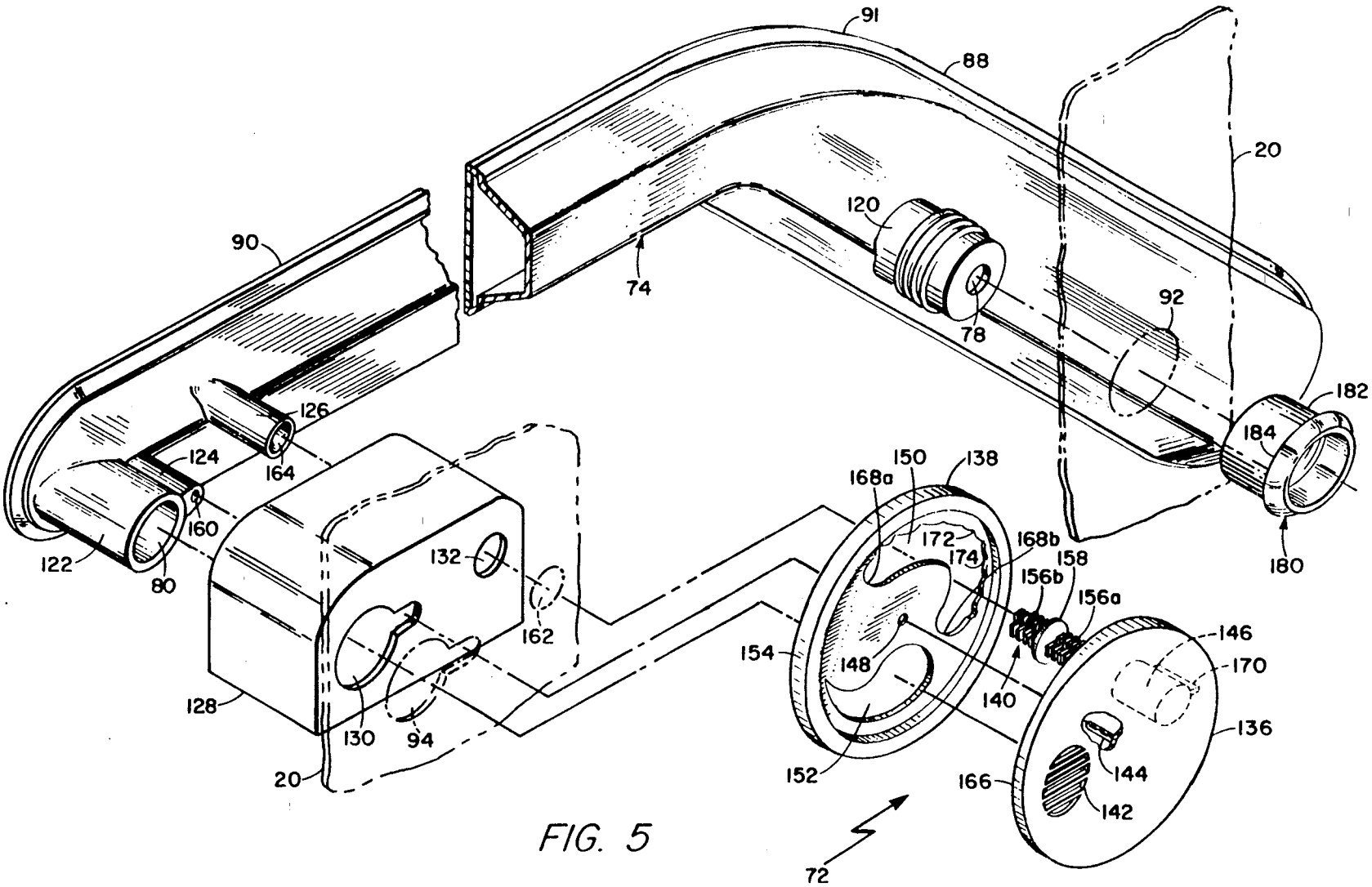
FIG. 5 is a perspective view of the duct with the air flow control exploded.

Referring to FIG. 5, outlet port 78 has a laterally extending cylindrical tunnel 120 or neck and outlet port 80 has a laterally extending tunnel 122 or neck having an axial rib 124. Further, as shown, a hollow cylinder or boss 126 extends adjacently parallel to tunnel 122. An EBS sealing block 128 having through cut-out portions 130 and 132 conforming respectively to tunnel 122 and boss 126 is inserted onto tunnel 122 and boss 126 and held in place by an interference fit.

In the next step of fabrication, the fresh food liner 18 is lowered into cabinet 118 laterally adjacent to freezer liner 28. Due to production tolerances and the fact that duct 74 is to run from the freezer liner 28 to the fresh food liner 18 which may be slightly misaligned from front-to-back and/or top-to-bottom, outlet ports 78 and 80 may not accurately align with respective inlet apertures 92 and 94 of fresh food liner 18. In order to compensate for any such misalignment, the heretofore described temporary holding tape is removed from duct 74, and then the front of duct 74 is adjusted to align outlet ports 78 and 80 with respective inlet apertures 92 and 94. More specifically, referring again to FIG. 8, distal portion 104 of latching collar 82 is free to move within outlet aperture 84 in the second predetermined or latched orientation of duct 74 to side wall 30 without disengaging ears 110*a* and *b* from respective peripheral portions along edges 112*a* and *b*. That is, distal portion 104 can here move forward and backward approximately ⅜" while ears 110*a* and *b* move in sliding engagement with and remain engaged to peripheral portions along edges 112*a* and *b*. Also, duct 74 may be slightly rotated from the orientation shown in FIG. 8 to provide some vertical alignment of outlet port 78 and 80 to respective inlet apertures 92 and 94. During such adjustment of duct 74 to align respective outlet ports 78 and 80 to inlet apertures 92 and 94, gasket 116 keeps latching collar 82 sealed to side wall 30 of freezer liner 28. In summary, outlet aperture 84 is formed so that substantially parallel edges 112*a* and *b* are larger than corresponding dimensions of collar 82 so that the joint or coupling so formed can be adjusted to align the outlet ports 78 and 80 while maintaining a seal at the joint.

Still referring to FIG. 5, air flow control 72 includes stationary circular face plate 136, rotatable shutter disc 138, and fastener clip 140. As shown, face plate 136 has a vent region 142 or grill, a perpendicularly extending central pin 144, and a perpendicularly projecting hollow cylinder 146. Rotatable shutter disc 138 has a central pin hole 148 adapted for receiving pin 144, and an arcuate slot 150 adapted for receiving cylinder 146. Rotatable disc 138 or shutter also has a tear drop opening 152 or air passage hole and a raised rim 154. During assembly, pin 144 is inserted through pin hole 148 with cylinder 146 extending through arcuate slot 150. Clip 140 has sets of resilient prongs 156*a* and *b* or fingers extending radially from both sides of disc 158. During assembly, the set of resilient prongs 156*a* is inserted in bore 147 of hollow cylinder 146. Inlet aperture 94 in side wall 20 of fresh food liner 18 is shaped to receive pin 144 which inserts in bore 160 of rib 124. Also, a separate hole 162 is disposed in alignment with hollow cylinder 126. The set of resilient prongs 156*b* inserts through hole 162 and securely engages into bore 164 of hollow cylinder 126 as pin 144 slides into bore 160. With such arrangement, clip 140, which is a so-called christmas tree clip, securely engages or mounts circular face plate 136 to duct 74, and prevents rotation of face plate about pin 144. In the fixed orientation, vent region 142 aligns with outlet port 80. In the described arrangement, rotatable shutter disc 138 is sandwiched between face plate 136 and liner wall 20. More specifically, face plate 136 has a lip 166 that seats against an annular portion of rotatable disc 138 inside raised rim 154 there capturing or locking rotatable shutter disc 138 against liner wall 20. However, rotatable shutter disc 138 is free to rotate on pin 144 within the arc of arcuate slot 150. That is, stationary clip 140 passes through arcuate slot 150 and rotatable shutter disc 138 can be rotated until the extremities 168*a* and *b* of slot engage clip 40.

Figure 9:
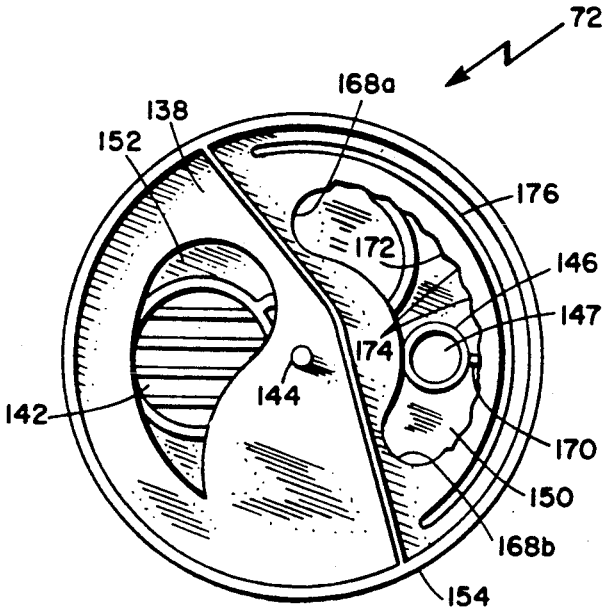
FIG. 9 is a rear view of the air flow control.

Referring to FIG. 9, hollow cylinder 146 has a vane 170 that engages a rippled or undulated edge 172 of arcuate slot 150. That is, slot 150 has a plurality of spaced indents 174. Rotatable shutter disc 138 also has an arcuate slit 176 to provide flex for edge 172. In such arrangement, cylinder 146 and vane 170 have an interference fit within arcuate slot 150 so there is calibrated resistance to rotation of rotatable shutter disc 138. Thus, as the operator grasps rim 154 of rotatable shutter disc 138 and exerts a rotational force to adjust the temperature setting of storage chamber 62, rotatable shutter disc 138 has the feel of clicking through a plurality of discrete positions or settings and, once settled in a position, the rotational friction is such that rotatable shutter disc 138 is secured in that position.

Still referring to FIG. 9 and also to FIG. 5, tear drop opening 152 is configured and oriented so that varying portions of tear drop opening 152 align with the grill of vent region 142 as rotatable shutter disc 138 is manually rotated between the ends of its rotatable arc defined by extremities 168*a* and *b* contacting clip 140. Thus, the size of the passageway through tear drop opening 152 and vent region 142 depends on the rotational orientation of rotatable shutter disc 138. In such manner, the operator manually rotates rotatable shutter disc 138 to set the air flow through air flow control 72. Referring again to FIG. 3, vent region 42 aligns with opening 70 into storage chamber 62. Therefore, the cold air flow from duct 74 into storage chamber 62 and thus the temperature within storage chamber 62 can be regulated by rotating rotatable shutter disc 138 either clockwise or counter-clockwise from maximum to minimum cooling.

Referring again to FIG. 5, convention grommet 180 is next inserted through inlet aperture 92. Grommet 180 has a barrel 182 which snugly fits around tunnel 120 providing a seal, and flange 184 seals to liner 20.

Referring again to FIG. 3, the fabrication process continues by foaming-in-place vertical partition 16 along with the other regions spaced between respective liners 18 and 28 and cabinet 118. As shown best in FIG. 5, duct 74 is of a trapezoid shape to improve the flow of foam vertically across duct 74. Next, the evaporator chamber 140 is formed in the rear of freezer liner 28.

In summary, duct 74 is coupled from freezer liner 28 to fresh food liner 18 to provide a flow of cold air directly from evaporator chamber 40 to meat keeper 56 and storage chamber 62. With such arrangement, the cold air is provided from a relatively constant pressure source. The coupling of latching collar 82 to outlet aperture 84 permits front-to-back and some vertical motion of duct 74 with respect to freezer liner 28 so that outlet ports 78 and 80 can be adjusted to align with respective inlet apertures 92 and 94; such adjustment compensates for tolerance in the alignment between fresh food liner 18 and freezer liner 28. Further, even though only one duct 74 is used to supply cold air to both meat keeper 56 and storage chamber 62, individual temperature control of the two storage chambers 56 and 62 is provided. More specifically, baffle 96 provides isolation between separate branches 98*a* and *b* within duct 74, and each branch 98*a* and *b* substantially communicates with plenum region 86 which has a relative constant pressure when fan 44 is operating. Thus, because each storage chamber 56 and 62 is substantially coupled individually to the plenum region 86, a change in the air flow rate down one branch 98*a* or *b* does not significantly effect the air flow rate to the opposite branch. Also, air flow control 72 provides individual temperature control for storage chamber 62. Meat keeper 56 may also have a conventional individual temperature control (not shown). For example, meat keeper 56 may have a slide control that regulates the flow of air exiting sleeve 60.

This concludes the description of the preferred embodiment. However, a reading of it by one skilled in the art will bring to mind many modifications and alterations which do not depart from the spirit and scope of the invention. Therefore, it is intended that the scope of the invention be limited only by the appended claims.

What is claimed is:

1. A refrigerator comprising:

a cabinet;

a freezer liner and a fresh food liner adjacently spaced within said cabinet, said freezer liner having an air outlet aperture and said fresh food liner having an air inlet aperture;

a duct extending between said air outlet aperture of said freezer liner and said air inlet aperture of said fresh food liner for conveying cold air, said duct comprising means for coupling said duct to said outlet aperture and for adjusting the position of said duct with respect to said outlet aperture during fabrication to align said duct to said inlet aperture of said fresh food liner while maintaining said coupling to said outlet aperture; and said duct comprising a port for receiving said cold air from said air outlet aperture and said coupling and adjusting means comprising a flange surrounding said port and extending through said air outlet aperture, said flange having a plurality of lugs engaging peripheral portions of said air outlet aperture and being insertable during fabrication through said air outlet aperture in a first predetermined orientation of said flange with respect to said air outlet aperture.

2. The refrigerator recited in claim 1 further comprising a storage chamber disposed to receive cold air from said duct through said inlet aperture of said fresh food liner.

3. The refrigerator recited in claim 1 wherein said peripheral portions of said air outlet aperture comprises a pair of parallel edges each having a length longer than a corresponding dimension of said flange so that said flange can be adjusted in position along said parallel edges during fabrication while said lugs move in sliding engagement along said parallel edges.

4. The refrigerator recited in claim 1 wherein said lugs engage said peripheral portions in a second predetermined orientation of said flange with respect to said air outlet aperture.

5. A refrigerator comprising:

a cabinet;

a freezer liner and a fresh food liner adjacently spaced within said cabinet, said freezer liner having an air outlet aperture and said fresh food liner having an air inlet aperture;

a duct extending between said air outlet aperture of said freezer liner and said air inlet aperture of said fresh food liner for conveying cold air, said duct comprising means for coupling said duct to said outlet aperture and for adjusting the position of said duct with respect to said outlet aperture during fabrication to align said duct to said inlet aperture of said fresh food liner while maintaining said coupling to said outlet aperture; and foamed-in-place insulation between said freezer and fresh food liners surrounding said duct.

6. The refrigerator recited in claim 5 further comprising a gasket surrounding said flange and being disposed between said duct and said freezer liner.

7. A refrigerator comprising:

an outer cabinet;

a freezer compartment comprising a freezer liner and a fresh food compartment comprising a fresh food liner, said freezer liner and said fresh food liner being laterally spaced in said cabinet forming a vertical partition region therebetween;

an evaporator disposed in an evaporator chamber within said freezer liner;

means comprising a fan for circulating air from said freezer and fresh food compartments through said evaporator chamber across said evaporator and back to said freezer and fresh food compartments;

a storage chamber disposed in said fresh food compartment;

said freezer liner having an outlet aperture communicating from said evaporator chamber to said vertical partition region;

said fresh food liner having an inlet aperture communicating from said vertical partition region to said storage chamber; and duct means disposed in said vertical partition region for conveying evaporator chamber air from said outlet aperture through said vertical partition region to said inlet aperture for discharge into said storage chamber, said duct means comprising a first port for receiving said air from said outlet aperture and a second port for discharging said air through said inlet aperture, said duct means further comprising a collar surrounding said first port and extending through said outlet aperture, said collar having a plurality of ears insertable through said outlet aperture in a first rotational orientation of said collar to said outlet aperture and engageable to peripheral portions of said outlet aperture in a second rotational orientation of said collar to said outlet aperture to interlock said duct means to said freezer liner in said second rotational orientation, said outlet aperture having at least one dimension larger than a corresponding dimension of said collar in said second rotational orientation so that said collar can be moved within said outlet aperture during fabrication to align said second port with said inlet aperture while maintaining sliding engagement of said ears on said peripheral portions to maintain said interlock between said duct means and said freezer liner in said second rotational orientation.

8. The refrigerator recited in claim 7 wherein said freezer liner outlet aperture has two substantially parallel edges approximately orthogonal to said ears in said second rotation orientation.

9. The refrigerator recited in claim 7 wherein said collar has an elongated cross-section.

10. The refrigerator recited in claim 9 wherein said collar cross-section has rounded ends.

11. The refrigerator recited in claim 10 wherein said ears project from said rounded ends.

12. The refrigerator recited in claim 8 wherein said collar has a distal portion of reduced cross-section defining a shoulder on said collar.

13. The refrigerator recited in claim 12 further comprising a gasket sandwiched between said shoulder and said freezer liner around said air outlet aperture.

14. The refrigerator recited in claim 8 further comprising foamed-in-place insulation in said vertical partition region surrounding said duct means.

15. The refrigerator recited in claim 8 wherein said fresh food compartment further comprises a door housing said storage chamber.

16. The refrigerator recited in claim 15 wherein said storage chamber in said door has an opening aligned with said inlet aperture when said door is closed.

17. A method of fabricating a refrigerator, comprising the steps of:

placing a freezer liner having a wall with an air outlet aperture into a cabinet;

inserting a mating flange of a duct through said aperture in a first rotational orientation of said mating flange to said freezer liner so that ears on said flange fit through said outlet aperture;

rotating said duct to orient said mating flange at a second rotational orientation wherein said ears engage peripheral portions of said outlet aperture to interlock said duct to said freezer liner;

placing a fresh food liner having a wall with an inlet aperture into said cabinet so that said wall of said freezer liner and said wall of said fresh food liner face and are spaced from each other to form a partition region in which said duct is positioned; and adjusting the position of said mating flange within said outlet aperture while maintaining said second rotational orientation so that said ears move in sliding engagement o said peripheral portions in said second rotational orientation of said duct to align an outlet port of said duct with said inlet aperture of said fresh food liner.

18. The method recited in claim 17 further comprising the step of foaming-in-place said partition region.

19. The method recited in claim 17 further comprising the step of positioning an air inlet opening of a storage chamber adjacent said inlet aperture of said fresh food liner to receive a flow of air from said duct.

* * * * *